United States Patent [19]

Peinecke et al.

[11] Patent Number: 4,702,324

[45] Date of Patent: Oct. 27, 1987

[54] CONTROL SYSTEM FOR POSITIONING AND OPERATING A PNEUMATIC PERCUSSION TOOL

[75] Inventors: Dale R. Peinecke, Glenshaw, Pa.; Casimir B. Robak, Jr., Newburgh, Ind.; Robert A. Dubs, Rochester, Pa.

[73] Assignee: Aluminum Company of America, Pittsburgh, Pa.

[21] Appl. No.: 609,857

[22] Filed: May 14, 1984

[51] Int. Cl.[4] ..... E21B 15/04

[52] U.S. Cl. ..... 173/39; 74/471 XY; 204/245

[58] Field of Search ..... 173/141, 39; 204/243, 204/245, 194, 67; 251/205, 204; 74/471 XY; 244/226, 234

[56] References Cited

U.S. PATENT DOCUMENTS

| | | | |
|---|---|---|---|
| 1,177,656 | 4/1916 | Sharp | 74/471 XY |
| 2,964,305 | 12/1960 | Samhammer et al. | 262/13 |
| 3,664,946 | 5/1972 | Schaper et al. | 204/245 X |
| 3,819,144 | 6/1974 | Hatlevoll et al. | 299/37 |
| 3,980,102 | 9/1976 | Kieson | 251/205 X |
| 4,027,547 | 6/1977 | Rahman et al. | 74/471 XY |
| 4,119,505 | 10/1978 | Baillot et al. | 204/67 |
| 4,191,359 | 3/1980 | Andersson et al. | 251/205 X |
| 4,418,435 | 12/1983 | Arnold | 15/4 |
| 4,563,255 | 1/1986 | Hentmann et al. | 204/67 |

*Primary Examiner*—E. R. Kazenske
*Assistant Examiner*—Willmon Fridie, Jr.
*Attorney, Agent, or Firm*—Glenn E. Klepac

[57] ABSTRACT

A control system controlling the movements of a pneumatic percussion tool for breaking crust away from anode butts in an electrolysis cell. The system comprises a control arm extending through first and second plates connected to respective first and second valve stems. In a preferred embodiment, the first valve stem operates a hydraulic scissors jack for extending and retracting the tool, and the second valve stem operates a hydraulic rotator motor for radially rotating a mast supporting the tool. A preferred system also comprises a pneumatic control valve connected to the control arm for positioning and energizing the percussion tool.

16 Claims, 6 Drawing Figures

72
50
75
47
26
59
46
45
63
64
53
41
52
62
65
Y
55
44
40
33
70

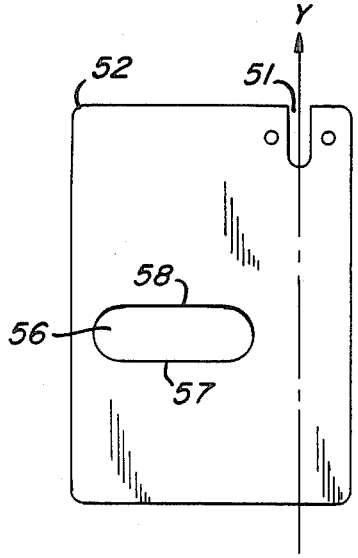
FIG. 4
FIG. 5
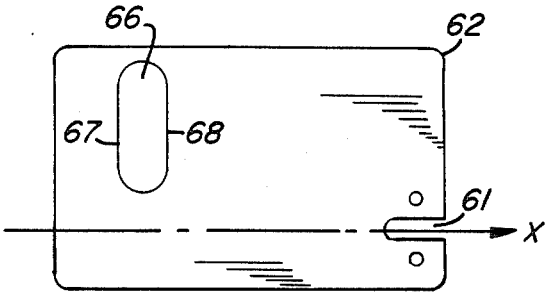
FIG. 6
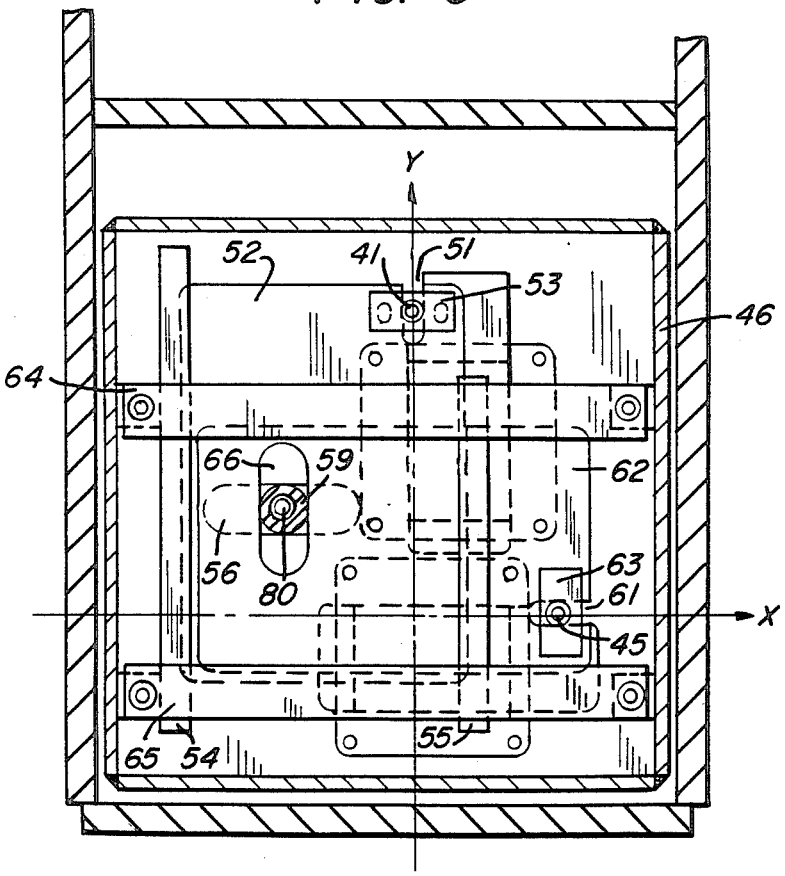

CONTROL SYSTEM FOR POSITIONING AND OPERATING A PNEUMATIC PERCUSSION TOOL

BACKGROUND OF THE INVENTION

The present invention relates to control systems for controlling movements of tools. More specifically, the invention relates to a unitary system for controlling the position of a pneumatic percussion tool by means of hydraulic devices and for energizing the percussion tool. The term "hydraulic devices" includes both hydraulic motors and hydraulic cylinders.

It is a principal object of the present invention to provide a system for concurrently controlling the position of a pneumatic tool by means of hydraulic devices and energizing the tool.

A related object of the invention is to provide a system for concurrently controlling at least two valve stems through a single control arm. A preferred system includes means for controlling three valve stems with a single control arm.

Additional objects and advantages of the invention will become apparent to persons skilled in the art from the following specification and drawings.

SUMMARY OF THE INVENTION

In accordance with the present invention, there is provided a control system including a control arm, first and second valve stems, and first and second plates connecting the control arm to the valve stems. The first plate is guided by track means for movement along a y-axis or first line and the second plate is guided by another track means for movement along an x-axis or second line that is non-parallel to the y-axis. Any y-directional movement of the control arm is translated through the first plate into y-directional movement of the first valve stem, and any x-directional movement of the control arm is translated through the second plate into x-directional movement of the second valve stem.

The first plate defines a through first orifice having opposed internal first side walls that are elongated parallel to the x-axis, and the second plate defines a through second orifice having a pair of opposed internal second side walls that are elongated parallel to the y-axis. The control arm extends through both plates, adjacent side walls in the orifices in each of the plates.

In a preferred control system, the first and second plates are generally parallel to one another and horizontal, and the control arm is generally vertical. In addition, the x-axis is non-coplanar with and generally perpendicular to the y-axis so that the side walls in the first orifice are aligned generally perpendicular to the y-axis and the side walls in the second orifice are aligned generally perpendicular to the x-axis.

A preferred control arm is supported by a fixed bracket and comprises an elongated hollow shaft, a rod interior of the shaft and a spring biasing the rod away from an actuating pin for a pneumatic control valve. When the rod is moved downwardly against the actuating pin, the pin energizes a pneumatic control valve for positioning and operating a pneumatic percussion tool. The preferred control system described herein was specifically designed for controlling a pneumatic percussion tool having a blunt head that breaks crust surrounding used anode butts in aluminum electrolysis cells. However, the control system is also applicable to other systems wherein at least two valve stems are movable in non-parallel directions or wherein a pneumatic tool is positioned by means of hydraulic devices.

BRIEF DESCRIPTION OF THE DRAWINGS

FIG. 4 is a top plan view of the first slide plate 52 shown in FIGS. 2 and 3.

FIG. 5 is a top plan view of the second slide plate 62 shown in FIGS. 2 and 3.

FIG. 6 is a cross-sectional view taken along the lines 6—6 of FIG. 3.

DETAILED DESCRIPTION OF THE PREFERRED EMBODIMENT

Figure 1:
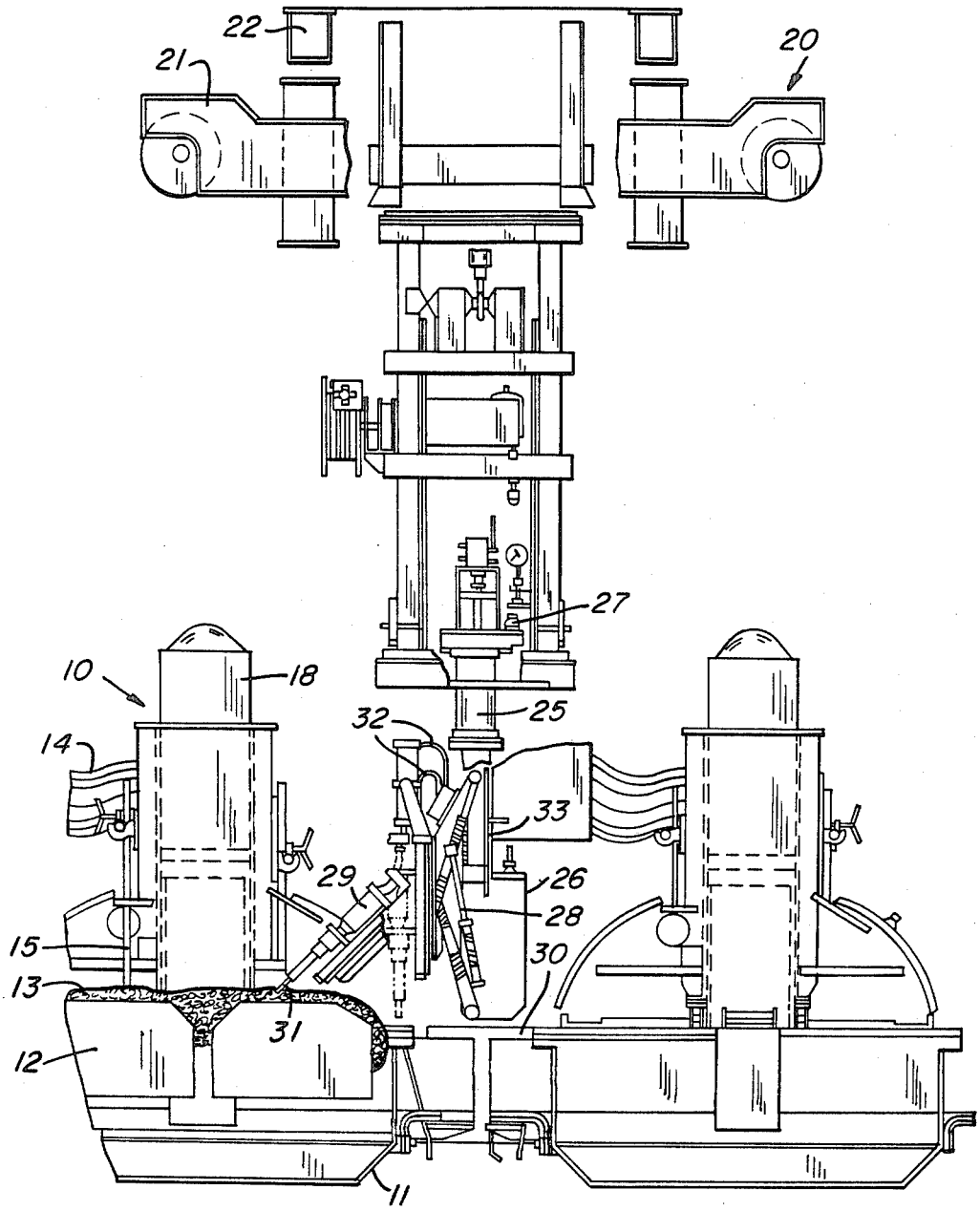
FIG. 1 is a schematic side elevational view of a manufacturing facility in which aluminum is produced by electrolysis, including a pneumatic percussion tool controlled by the control system of the present invention.

A manufacturing facility for production of aluminum by electrolysis is shown schematically in FIG. 1. The facility includes an electrolytic cell 10 comprising a steel-walled shell 11 containing an anode 12, the top and sides of which are covered by a hard crust 13. The anode 12 is connected to an electric current source 14 through an anode rod 15. An exhaust duct 18 carries exhaust gases away from the interior of the cell 10.

After an anode has been used for a few weeks, it must be replaced. A used anode remaining attached to the anode rod is called an "anode butt". When the time comes to replace an anode butt, solidified electrolyte or crust must be broken away from the perimeter of the butt in the cell. The task of breaking crust around used anode butts in the cell is arduous and time-consuming because of the high temperatures, dusty atmosphere and cramped conditions under which this job must be performed.

In accordance with the present invention, the aluminum production facility comprises an overhead crane 20 having a bridge 21 that supports a laterally movable overhead trolley 22. A generally vertical mast 25 is suspended downwardly from the trolley 22. The mast 25 supports a control system 26; a hydraulic rotator motor 27 for rotating the mast 25 radially with respect to the trolley 22: and a hydraulic scissors jack 28 carrying a pneumatic percussion tool or jackhammer 29. An operator (not shown) stands to the right of the control system 26 on a platform 30 above the cell 10.

The percussion tool 29 includes a blunt head 31 for hammering encrusted electrolyte 13 away from the anode butt 12. The tool 29 is powered by an air compressor (not shown) connected to the tool 29 by hoses 32. When the pneumatic tool 29 is activated, the head 31 is extended toward the butt 12 and then strikes the crust 13 repeatedly and breaks it into pieces. An elongated vertical wall 33 is positioned between the control system 26 and the tool 29.

Figure 2:
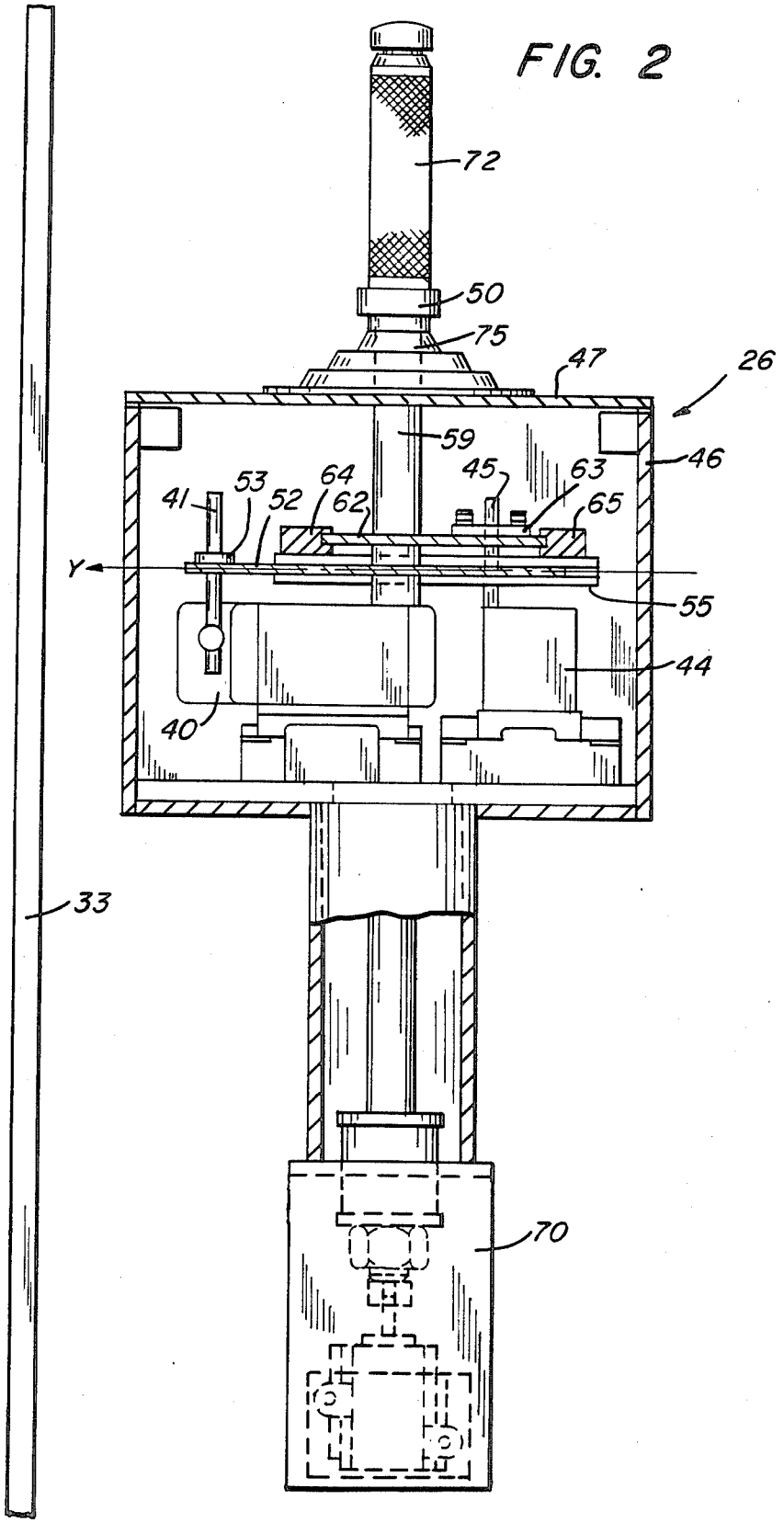
FIG. 2 is a first sectional view of the control system of the invention.
Figure 3:
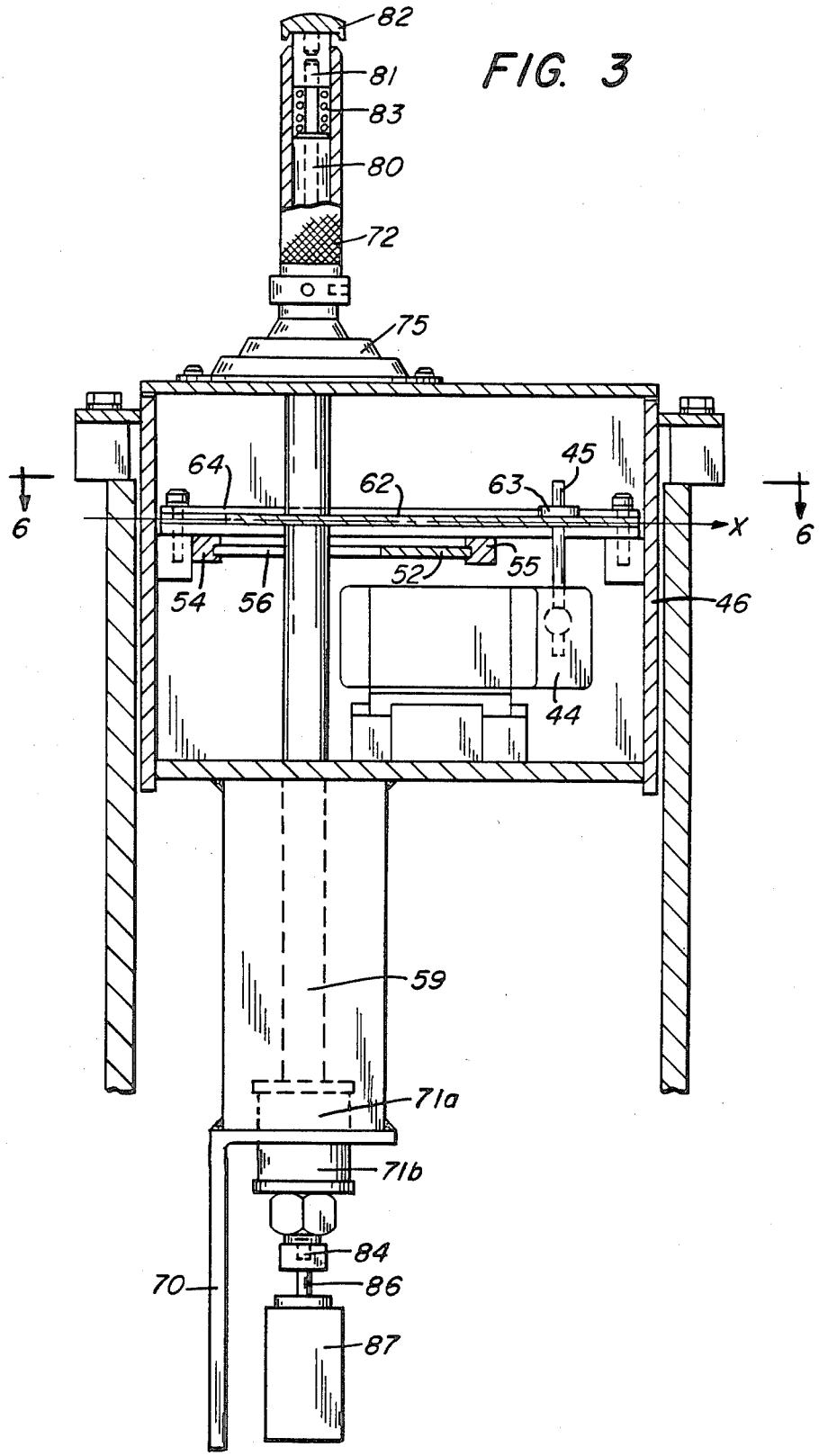
FIG. 3 is a second sectional view of the control system, taken at a right angle to FIG. 2.

Referring now more particularly to FIGS. 2 and 3, the control system 26 comprises a first valve 40 having a first valve stem 41 together with an adjacent second valve 44 having a second valve stem 45. Both valves 40, 44 are confined in a dust-tight enclosure box 46. The box 46 is provided with a removable top lid 47 for ease in replacing damaged or worn out parts of the control system 26. The valves are controlled manually by a generally vertical control arm 50 extending vertically through the box 46.

As shown in FIGS. 2, 3 and 6, the first valve stem 41 extends through a small slot 51 in a generally horizontal first plate or slide plate 52. The valve stem 41 is attached to the plate 52 by a means of a small collar 53. The first plate 52 is guided along the y-axis by a first track means comprising laterally opposed grooved tracks 54, 55. As shown in FIGS. 4 and 6, the first plate 52 also defines a through first orifice 56 having opposed internal first side walls 57, 58. A shaft 59 of the control arm 50 passes through this first orifice 56.

Referring now to FIGS. 1, 2 and 6, the first valve 40 and valve stem 41 control the hydraulic scissors jack 28. When the valve stem 41 moves forwardly along the y-axis (leftwardly in FIG. 2), the jack 28 is extended. When the valve stem 41 is moved rearwardly or rightwardly along the y-axis in FIG. 2, the jack 28 is retracted towards the control system 26.

The second valve stem 45 extends through a small slit 61 in a generally horizontal second plate or slide plate 62. The second valve stem 45 is attached to the plate 62 by means of an adjustable collar 63. The second plate 62 is guided along the x-axis (shown in FIGS. 3 and 6) by a second track means comprising laterally opposed grooved tracks 64, 65.

As shown in FIGS. 5 and 6, the second plate 62 defines a second through orifice 66 having opposed internal second side walls 67, 68. The control arm shaft 59 passes through this second orifice 66 adjacent the side walls 67, 68.

Referring now to FIGS. 1, 3 and 6, the second valve 44 and valve stem 45 control the hydraulic rotator motor 27 referred to above. When the valve stem 45 is moved leftwardly along the x-axis shown in FIGS. 3 and 6, the valve 44 causes the motor 27 to rotate the mast 25 leftwardly or counterclockwise. Conversely, when the valve stem 45 is moved to the right, the valve 44 causes the motor 27 to rotate the mast 25 in a rightward or clockwise direction.

As shown in FIGS. 2 and 3, the control system 26 further comprises a fixed, generally L-shaped bracket 70 to which the control arm 50 is attached by means of two flexible bushings 71*a*, 71*b*. The control arm 50 further comprises a handle 72 located above the box 46. The control arm 50 is pivotably movable about the bracket 70 when manual force is applied to the handle 72. The bushings 71*a*, 71*b* bias the control arm 50 toward a center position.

A flexible butyl rubber boot 75 is mounted on the box lid 47 below the handle 72. The boot 75 protects the interior of the box 46 from dust contamination.

Referring now to FIGS. 2 and 3, the control arm comprises an elongated, hollow, generally vertical shaft 59. A rod or push rod 80 is situated inside the shaft. The rod 80 includes an upper end portion 81 adjacent to a button 82. A spring or spring means 83 biases the rod 80 upwardly, toward the button 82. A lower end portion 84 of the rod 80 extends downwardly below the shaft 59.

The system further comprises an actuating pin 86 located adjacent to and downward of the lower end portion 84. The actuating pin 86 is a pilot switch for a pneumatic control valve 87. When the operator applies sufficient manual force onto the button 82 to move the rod 80 and actuating pin 86 downwardly, the valve 87 is energized. Energizing the valve 87 causes the pneumatic tool 29 to extend the head 31 toward the butt 12 and thereafter perform its work on the crust 13.

The pneumatic percussion tool system described above can be controlled with only one hand by a skilled operator. Because the system is easily controlled, the operator is able to observe the progress of his work while simultaneously manipulating the control system. In addition, the system has a lower purchase price and substantially reduced maintenance costs compared with prior art control systems.

The foregoing description of our invention is based upon a single preferred embodiment. Persons skilled in the art will understand that numerous changes and modifications can be made therein without departing from the spirit and scope of the following claims.

What is claimed is:

1. A control system for concurrently controlling at least two valve stems, comprising (a) a first valve stem, a generally horizontal first plate connected to said first valve stem and first track means guiding said first plate for movement along a y-axis, said first plate defining a first orifice extending through the plate and having a pair of opposed internal first side walls, said first side walls being elongated parallel to an x-axis that is non-parallel to the y-axis, (b) a second valve stem, a generally horizontal second plate connected to said second valve stem and second track means guiding said second plate for movement along the x-axis, said second plate defining a second orifice extending through the plate and having a pair of opposed internal second side walls, said second side walls being elongated parallel to the y-axis, (c) a generally vertical control arm extending through said first orifice and said second orifice, whereby y-directional movement of said control arm is translated through said first plate into y-directional movement of said first valve stem, and x-directional movement of said contol arm concurrently is translated through said second plate into x-directional movement of said second valve stem, said control arm comprising (1) an elongated hollow generally vertical shaft, (2) a rod interior of said shaft and having an upper end portion adjacent to a button extending above the shaft and a lower end portion extending below the shaft, and (3) spring means biasing said rod upwardly, (d) a fixed bracket attached to said control arm below said plates, said control arm including a handle above said plates, said control arm being pivotally movable upon application of manual force to the handle, and (e) an actuating pin for a pneumatic control valve, said pin being adjacent to and downward of the lower end portion of the rod, said actuating pin energizing the pneumatic control valve upon application of sufficient manual force on the button to move the rod and actuating pin downwardly.

2. The control system of claim 1 wherein said first plate is generally parallel to said second plate.

3. The control system of claim 2 wherein the x-axis is non-coplanar with and aligned generally perpendicular to the y-axis.

4. The control system of claim 1 wherein the first side walls in said first orifice are aligned generally perpendicular to the y-axis and the second side walls in said second orifice are aligned generally perpendicular to the axis.

5. The control system of claim 1 wherein said pneumatic control valve controls a pneumatic percussion tool for breaking crust around the perimeter of an anode butt in an electrolysis cell.

6. The control system of claim 1 wherein said first and second valve stems are each connected to a hydraulic valve.

7. The control system of claim 1 further comprising (f) a laterally movable overhead trolley, (g) a generally vertical mast suspended downwardly from said trolley and supporting the valve stems and control arm, and (h) a hydraulic rotator device for rotating said mast radially with respect to said trolley, said rotator device being supported by said trolley and connected to said mast, said rotator device including a first control valve connected to said first valve stem.

8. The control system of claim 7 further comprising (i) a hydraulic scissors jack supported by said mast and carrying a pneumatic percussion tool, said scissors jack including a second control valve connected to said second valve stem, said scissors jack extending or retracting said tool with respect to the mast upon activation of said second control valve.

9. A control system and pneumatic percussion tool system, comprising (a) a first valve stem, a first plate connected to said first valve stem first track means guiding said first plate for movement along a y-axis, said first plate defining a first orifice extending through the plate and having a pair of opposed internal first side walls, said first side walls being elongated parallel to an x-axis that is non-parallel to the y-axis, (b) a second valve stem, a second plate connected to said second valve stem and second track means guiding said second plate for movement along the x-axis, said second plate defining a second orifice extending through the plate and having a pair of opposed internal second side walls, said second side walls being elongated parallel to the y-axis, (c) a control arm extending through said first orifice and said second orifice, said control arm abutting laterally against at least one of said first and second side walls upon application of manual force, whereby y-directional movement of said control arm is translated through said first plate into y-directional movement of said first valve stem, and x-directional movement of said control arm concurrently is translated through said second plate into x-directional movement of said second valve stem, (d) a laterally movable overhead trolley, (e) a generally vertical mast suspended downwardly from said trolley and supporting the valve stems and control arm, (f) a hydraulic rotator device for rotating said mast radially with respect to said trolley, said rotator device being supported by said trolley and connected to said mast, said rotator device including a first control valve connected to said first valve stem, and (g) a hydraulic scissors jack supported by said mast and carrying a pneumatic percussion tool, said scissors jack including a second control valve connected to said second valve stem, said scissors jack extending or retracting said tool with respect to the mast upon activation of said second control valve.

10. The system of claim 9 wherein said first plate is generally parallel to said second plate.

11. The system of claim 10 wherein the x-axis is non-coplanar with and aligned generally perpendicular to the y-axis.

12. The system of claim 9 wherein the first side walls in said first orifice are aligned generally perpendicular to the y-axis and the second side walls in said second orifice are aligned generally perpendicular to the x-axis.

13. The system of claim 9 wherein said first plate and second plate are generally horizontal and said control arm is generally vertical.

14. The system of claim 13 further comprising (h) a fixed bracket attached to said control arm below said plates, said control arm including a handle above said plates, said control arm being pivotally movable upon application of manual force to the handle.

15. The control system of claim 13 wherein said control arm comprises (1) an elongated hollow generally vertical shaft, (2) a rod interior of said shaft and having an upper end portion adjacent to a button extending above the shaft and a lower end portion extending below the shaft, and (3) spring means biasing said rod upwardly; said control system further comprising (e) an acutuating pin for a pneumatic control valve, said pin being adjacent to and downward of the lower end portion of the rod, said actuating pin energizing the pneumatic control valve upon application of sufficient manual force on the button to move the rod and actuating pin downwardly.

16. The system of claim 15 wherein said pneumatic control valve controls a pneumatic percussion tool for breaking crust around the perimeter of an anode butt in an electrolysis cell.

* * * * *